US008385805B2

(12) United States Patent
Fujihara

(10) Patent No.: US 8,385,805 B2
(45) Date of Patent: Feb. 26, 2013

(54) FIXING MEMBER, FIXING APPARATUS AND IMAGE FORMING APPARATUS

(75) Inventor: Issei Fujihara, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 243 days.

(21) Appl. No.: 12/861,331

(22) Filed: Aug. 23, 2010

(65) Prior Publication Data

US 2011/0206428 A1 Aug. 25, 2011

(30) Foreign Application Priority Data

Feb. 25, 2010 (JP) ..... 2010-040800

(51) Int. Cl.
*G03G 15/20* (2006.01)

(52) U.S. Cl. ..... 399/333; 399/329

(58) Field of Classification Search ..... 399/333, 399/329, 330
See application file for complete search history.

(56) References Cited

U.S. PATENT DOCUMENTS 5,621,512 A 4/1997 Uehara et al.
6,490,430 B1 * 12/2002 Chen et al. ..... 399/333
2005/0201784 A1 9/2005 Suzuki
2010/0119269 A1 * 5/2010 Kondoh et al. ..... 399/333

FOREIGN PATENT DOCUMENTS

| | | | |
|---|---|---|---|
| JP | B2-3215230 | | 10/2001 |
| JP | A-2001-331049 | | 11/2001 |
| JP | B2-3298354 | | 7/2002 |
| JP | A-2002-251092 | | 9/2002 |
| JP | A-2003-012885 | | 1/2003 |
| JP | 2004126254 | A * | 4/2004 |
| JP | A-2005-070453 | | 3/2005 |
| JP | A-2005-091921 | | 4/2005 |
| JP | A-2005-257989 | A1 | 9/2005 |
| JP | A-2005-258432 | | 9/2005 |
| JP | A-2008-203401 | | 9/2008 |
| JP | B2-4207202 | | 1/2009 |

* cited by examiner

*Primary Examiner* — David Gray
*Assistant Examiner* — Sevan A Aydin
(74) *Attorney, Agent, or Firm* — Oliff & Berridge, PLC

(57) ABSTRACT

A fixing member includes a tubular surface layer having a first band section including a resin composition that contains a heat resistant resin having releasability, and a second band section having a higher mechanical strength than the resin composition, and the first band section and the second band section is respectively disposed along a circumferential direction of the surface layer and is disposed alternately in a width direction of the surface layer.

5 Claims, 7 Drawing Sheets

FIXING MEMBER, FIXING APPARATUS AND IMAGE FORMING APPARATUS

CROSS-REFERENCE TO RELATED APPLICATION

This application is based on and claims priority under 35 USC 119 from Japanese Patent Application No. 2010-040800 filed on Feb. 25, 2010.

BACKGROUND

1. Technical Field

The present invention relates to a fixing member, a fixing apparatus and an image forming apparatus.

2. Related Art

In image forming apparatuses such as copying machines which use an electrophotographic system, a heat fixing method is widely used. Examples of a fixing apparatus used in the heat fixing method include a fixing apparatus using a belt nip method, in which the outer peripheral surface of an endless fixing belt is pressed against the outer peripheral surface of a fixing roll to form a contact region, and a recording medium such as paper is passed through the contact region between the fixing belt and the fixing roll in a state in which it is inserted therebetween (see Japanese Patent No. 3298354).

SUMMARY

According to an exemplary embodiment of the invention, there is provided a fixing member including a tubular surface layer having a first band section including a resin composition that contains a heat resistant resin having releasability, and a second band section having a higher mechanical strength than that of the resin composition, the first band section and the second band section being respectively disposed along the circumferential direction of the surface layer and being disposed alternately in the width direction of the surface layer.

According to an another exemplary embodiment of the invention, there is provided a fixing member having a tubular surface layer including a resin composition that contains a heat resistant resin having releasability, and a band section embedded in the tubular surface layer and having a higher mechanical strength than the resin composition, the band section being disposed along the circumferential direction of the surface layer and being disposed at an interval in the width direction of the surface layer.

BRIEF DESCRIPTION OF THE DRAWINGS

Exemplary embodiments of the present invention will be described in detail based on the following figures, wherein.

DETAILED DESCRIPTION

Figure 1:
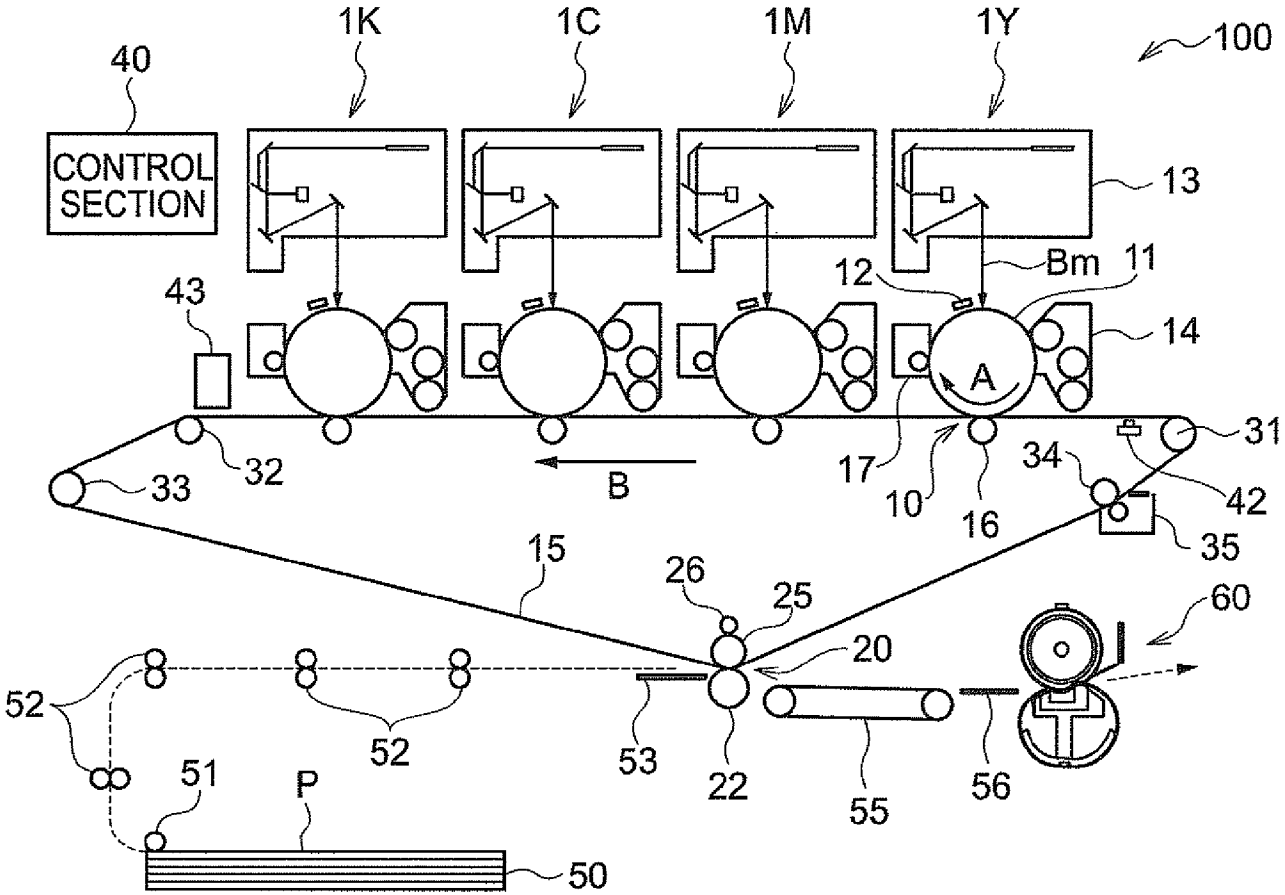
FIG. 1 is a schematic constitutional diagram showing an example of the image forming apparatus according to an exemplary embodiment of the invention.

Hereinbelow, the exemplary embodiment of the invention is described with reference to the drawings. The drawings are used for the purpose of illustrating the exemplary embodiment of the invention, and are not intended to represent the actual size. Furthermore, members having a substantially identical function are given an identical reference number throughout the drawings, and explanation will not be repeated.

The fixing member according to a first exemplary embodiment of the invention includes a tubular surface layer having a first band section including a resin composition that contains a heat resistant resin having releasability, in which a second band section having a higher mechanical strength than the resin composition, and the first band section and the second band section are respectively disposed along the circumferential direction of the surface layer and are disposed alternately in the width direction of the surface layer.

The fixing member according to a second exemplary embodiment of the invention includes a tubular surface layer composed of a resin composition that includes a heat resistant resin having releasability, and a band section embedded in the tubular surface layer and having a higher mechanical strength than the resin composition, the band section being disposed along the circumferential direction of the surface layer and being disposed at an interval in the width direction of the surface layer.

When the fixing member according to the exemplary embodiment of the invention has the configurations described above, abrasion caused by the edges of recording media may be suppressed.

In conventional fixing apparatuses, the occurrence of wrinkles in the recording medium (for example, paper) or the occurrence of image slippage is suppressed by controlling the shape of a pair of fixing members or the pressure distribution of the contact area (nip area) between a pair of fixing members in order to prevent the occurrence of wrinkles in the recording medium (for example, paper), and thereby applying a tensile force in the width direction from the center toward the edges of the fixing members.

Accordingly, sliding between the edges of the recording medium and the fixing member occurs more easily at the edges of the recording medium, and the abrasion that is concomitant with the sliding increases. Therefore, in a fixing member, if abrasion resistance is low, early wearing-down of the surface layer at the edges of the recording medium and denudation of the base material layer occur, leading to image failure due to sticking of toner or rolling of the recording medium. For this reason, it is particularly important to enhance the overall abrasion resistance as well as to enhance the abrasion resistance at the edges of the recording medium.

Furthermore, the rate of abrasion by the edges of the recording medium at the surface layer of the fixing member increases as the speed of passage of the recording medium increases, and an improvement in the abrasion resistance of the surface layer in the fixing member is also important in view of increased speed of the image forming apparatus.

Here, as a technique for improving the abrasion resistance of the surface layer of the fixing member, it is generally suggested to incorporate an inorganic filler or to incorporate a heat resistant resin powder, into a heat resistant resin having releasability with respect to toner, or to form, in a heat resistant resin having releasability with respect to toner, a network of a heat resistant resin having a higher strength than the heat resistant resin having releasability. However, in all of these techniques, a surface construction that is even in the conveyance direction of the recording medium is obtained.

The fixing members related to the first and the second exemplary embodiments of the invention are constructed to have a band section which has a higher mechanical strength than other regions and runs along the circumferential direction of the surface layer, at an interval in the width direction of the surface layer (in the first exemplary embodiment, the band section is provided so as to divide the surface layer, while in the second exemplary embodiment, the band section is provided so as to be embedded in the surface layer). Then, at the time of fixing, the edges of the recording medium are brought into contact with the surface layer at the region substantially composed of only the resin composition that contains a heat resistant resin having releasability and at the region including a band section having a higher mechanical strength than the resin composition and formed along the circumferential direction of the surface layer, in an alternating manner.

For this reason, it is believed that abrasion caused by the edges of the recording medium may be suppressed when the region substantially composed of only the resin composition that includes a heat resistant resin having releasability is reinforced by the band section having a higher mechanical strength than the resin composition, against the force of friction or turning in the direction of conveyance of the recording medium at the edges of the recording medium.

That is, wear of the surface layer of the fixing member is suppressed and, when the surface layer includes a filler, detachment may be suppressed. As a result, sticking of toner due to wearing-down of the surface layer, or jamming of the recording medium due to sticking may be suppressed, and the service life may be increased.

Particularly, in the fixing member according to the first exemplary embodiment, a band section that has a higher mechanical strength than other areas and that runs along the circumferential direction of the surface layer, is provided to be disposed at an interval in the width direction so as to divide the surface layer and is disposed so as to be exposed at the surface layer, and therefore, the fixing member may be more advantageous in that abrasion caused by the edges of the recording medium is suppressed, as compared with the second exemplary embodiment of the invention On the other hand, in the fixing member according to the second exemplary embodiment of the invention, a band section that has a higher mechanical strength than other areas and runs along the circumferential direction of the surface layer, is provided to be embedded in the surface layer and is disposed without being exposed at the surface layer, and therefore, the fixing member is more advantageous in that releasability with respect to toner is increased, as compared with the first exemplary embodiment.

Image Forming Apparatus

First, an image forming apparatus to which the fixing member according to the exemplary embodiment of the invention is used is explained. The image forming apparatus to which the fixing member according to the exemplary embodiment of the invention is applied is not particularly limited as long as the apparatus can fix an unfixed toner image on a recording medium by applying heat and pressure. In this exemplary embodiment, an explanation is given by taking an example of an image forming apparatus of an intermediate transfer system generally called as tandem type.

The image forming apparatus 100 according to the exemplary embodiment of the invention includes, as an image forming section, plural image forming units 1Y, 1M, 1C and 1K, which form toner images of the respective color components by an electrophotographic method, as shown in FIG. 1. The image forming apparatus also includes, as a transfer section, a primary transfer section 10 which transfers the toner images of the respective color components formed on the respective surfaces of image holding bodies 11 by the respective image forming units 1Y, 1M, 1C and 1K, sequentially to an intermediate transfer belt 15 (primary transfer); and a secondary transfer section 20 which collectively transfers the superimposed toner images that have been transferred onto the intermediate transfer belt, to paper P, which is a recording medium (secondary transfer). Furthermore, the image forming apparatus includes, as a fixing section, a fixing apparatus 60 which fixes the secondary transferred image onto the paper P. The image forming apparatus also has a control section 40 which controls the operation of the respective apparatuses (respective sections).

Each of the image forming units 1Y, 1M, 1C and 1K has an image holding member (photoreceptor drum) 11 that rotates in the direction of arrow A; a charging unit 12 that charges the photoreceptor drum 11; a laser exposure unit 13 that forms an electrostatic latent image on the photoreceptor drum 11; and a developing unit 14 that holds a toner of each color component and visualizes the electrostatic latent image on the photoreceptor drum 11 using the toner, thereby forming a toner image. Each of the image forming units 1Y, 1M, 1C and 1K also includes a primary transfer roll 16 that transfers the toner image of each color component formed on the photoreceptor drum 11 to the intermediate transfer belt 15 at the primary transfer section 10; and a foreign substance removing member (drum cleaner) 17 that removes residual toner on the photoreceptor drum 11. These image forming units 1Y, 1M, 1C and 1K are disposed in an approximately linear array in the order of yellow (Y), magenta (M), cyan (C) and black (K) from the upstream side of the intermediate transfer belt 15.

The intermediate transfer belt 15 is rotary-driven in the direction of arrow B as shown in FIG. 1, by various rolls. The various rolls include a driving roll 31 that drives the intermediate transfer belt 15; a supporting roll 32 that supports the intermediate transfer belt 15; a tension roll 33 that exerts a constant tension to the intermediate transfer belt 15 and also prevents meandering; a backside roll 25 that is provided in the secondary transfer section 20; and a cleaning section backside roll 34 which is provided in the cleaning section that scrapes off residual toner on the intermediate transfer belt 15.

The primary transfer section 10 has a primary transfer roll 16 that is faced to the photoreceptor drum 11, with the intermediate transfer belt 15 disposed therebetween. The secondary transfer section 20 includes a secondary transfer roll (transfer member) 22 that is disposed on the side of the toner image holding surface of the intermediate transfer belt 15; a backside roll 25 that is disposed on the rear surface side of the intermediate transfer belt 15 as a counter electrode of the secondary transfer roll 22; and a power supply roll 26 that applies a secondary transfer bias to the backside roll 25.

An intermediate transfer belt cleaner 35 which removes the residual toner or paper dust on the intermediate transfer belt 15, is disposed on the downstream side of the secondary transfer section 20. Disposed on the upstream side of the yellow image forming unit 1Y is a reference sensor (home position sensor) 42, which generates reference signals for picking the timing of image forming in the respective image forming units 1Y, 1M, 1C and 1K. Also disposed on the downstream side of the black image forming unit 1K is an image density sensor 43 for adjusting the image quality.

A paper conveyance system includes a paper holding unit 50; a pickup roll 51 that takes out and conveys paper (P) in the paper holding unit 50; a conveyance roll 52 that conveys the paper P; a conveyance stand 53 that sends the paper P to the secondary transfer section 20; a conveyance belt 55 that conveys the paper P which has been subjected to secondary transfer by the secondary transfer roll 22, to the fixing apparatus 60; and a fixing entrance guide 56 that guides the paper P to the fixing apparatus 60.

Next, the fundamental process of the image forming apparatus 100 according to the exemplary embodiment of the invention is explained.

In the image forming apparatus 100 according to the exemplary embodiment of the invention, image data that have been output from an image reading apparatus (not shown) or the like are subjected to imaging, and then the image data are converted to coloring material gradation data of four colors Y, M, C and K, and are output to a laser exposure unit 13. The laser exposure unit 13 irradiates, for example, an exposure beam Bm that has been output from a semiconductor laser to each of the photoreceptor drums 11 that rotate in the direction of arrow A in the image forming units 1Y, 1M, 1C and 1K, in accordance with the input coloring material gradation data. The surface of each of the photoreceptor drums 11 is charged with a charging unit, and then the surface is scan exposed by the laser exposure unit 13, so that an electrostatic latent image is formed. The formed electrostatic latent image is developed by each of the image forming units 1Y, 1M, 1C and 1K into a toner image of each color of Y, M, C or K.

Subsequently, the toner images formed on the photoreceptor drums 11 are sequentially superimposed on the surface of the intermediate transfer belt 15 in each of the primary transfer sections 10 to perform primary transfer. The intermediate transfer belt 15 moves in the direction of arrow B and conveys the toner image to the secondary transfer section 20. The paper conveyance system supplies paper P from the paper holding unit 50 on time for conveying the toner images to the secondary transfer section 20.

In the secondary transfer section 20, the unfixed toner images held on the intermediate transfer belt 15 are electrostatically transferred onto the paper P which is inserted between the intermediate transfer belt 15 and the secondary transfer roll 22. Subsequently, the paper P to which the toner images have been electrostatically transferred, is conveyed to the fixing apparatus 60 by the conveyance belt 55, and the fixing apparatus 60 fixes the toner images to the paper P by applying heat and pressure to the unfixed toner images on the paper P. The paper P having a fixed image formed thereon is conveyed to a discharged paper receiver unit (not shown) provided at the discharge unit of the image forming apparatus 100.

Fixing Apparatus

Figure 2:
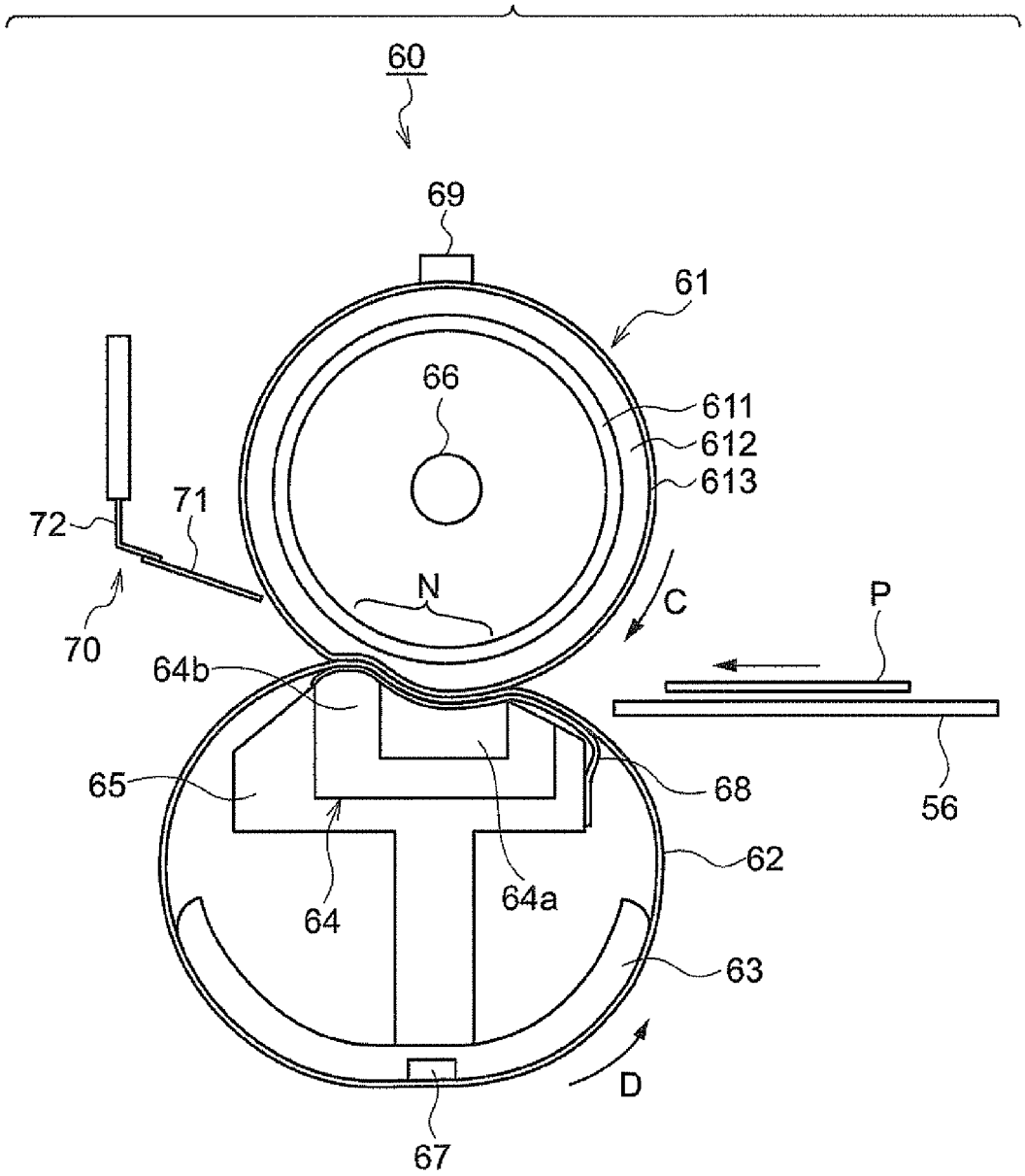
FIG. 2 is a schematic constitutional diagram showing an example of the fixing apparatus according to an exemplary embodiment of the invention.

Hereinbelow, the fixing apparatus 60 is more specifically explained with reference to FIGS. 2 and 3. As shown in FIG. 2, the main part of the fixing apparatus 60 includes a fixing roll (first rotating body) 61 which is rotary-driven in the direction of rotation C; a fixing belt (second rotating body) 62 which rotates (driven rotation) in the direction of rotation D in conjunction with the rotation of the fixing roll 61; a pressure pad 64 serving as a pressure member that is disposed at the inner side of the fixing belt 62 and presses the fixing belt 62 to the fixing roll 61 (here, the pressure pad includes an elastic pressure pad 64*b* and a high stiffness pad 64*a*); and a sheet-shaped sliding member 68.

In addition, a peeling member 70 is provided on the downstream side of the contact region N, as an auxiliary unit that peels the paper P from the fixing roll 61. The peeling member 70 includes a peeling baffle 71 that is disposed adjacent to the fixing roll 61 in the direction opposite (counter direction) to the rotation direction C of the fixing roll 61; and a holder 72 that holds the peeling baffle 71.

The pressure member is not specifically limited to this exemplary embodiment, as long as the fixing belt 62 and the fixing roll 61 are disposed such that they are relatively pressed each other. Therefore, the fixing belt 62 may be pressed by the fixing roll 61, or the fixing roll 61 may be pressed by the pressure pad 64 via the fixing belt 62.

The fixing roll 61 includes a heat resistant elastomer layer 612 and a releasing layer 613 formed on a metal core (cylindrical metal core) 611.

The outer diameter and thickness of the core 611 according to the exemplary embodiment of the invention are usually such that the outer diameter is from 20 mm to 40 mm, and the thickness is, for example, from about 1 mm to about 3 mm in the case of a core made of aluminum, and from about 0.4 mm to about 1.5 mm in the case of a core made of SUS or iron.

Examples of the material for the heat resistant elastomer layer 612 include a silicone rubber and a fluororubber, which have a hardness of from 15° to 45° (JIS-A).

The material for the releasing layer 613 may be a fluorine resin. Specific examples thereof include a tetrafluoroethylene-perfluoroalkyl vinyl ether copolymer (PFA), polytetrafluoroethylene (PTFE), and a tetrafluoroethylene-hexafluoropropylene copolymer (FEP). Furthermore, composite materials thereof, and products obtained by incorporating filler such as carbon, aluminum or barium sulfate to those resins may also be used. The thickness of the releasing layer 613 is preferably from 5 μm to 50 μm, and more preferably from 10 μm to 40 μm. In the exemplary embodiment of the invention, the core is covered with a PFA tube having a thickness of 30 μm.

A halogen heater 66 is disposed inside the fixing roll 61, as a heating unit. A temperature sensor 69 is disposed at the surface of the fixing roll 61 to be in contact with the surface. The control section 40 (see FIG. 1) of the image forming apparatus 100 controls lighting of the halogen heater 66 based on the temperature measurement values obtained by the temperature sensor 69, and regulates such that the surface temperature of the fixing roll 61 maintains the preset temperature (for example, 170° C.).

Figure 3:
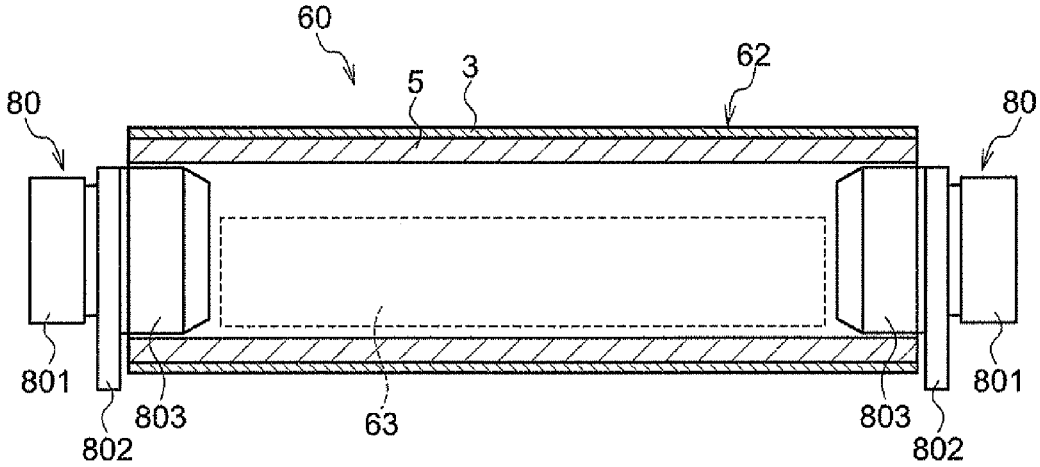
FIG. 3 is a schematic cross-sectional view showing the structure on the fixing belt side of the fixing apparatus according to an exemplary embodiment of the invention.

The fixing belt 62 is supported to be freely rotatable by the pressure pad 64 and a belt running guide 63 that are disposed inside the fixing belt, and as shown in FIG. 3, also by a meandering prevention member 80 disposed at the two edges. The belt running guide 63 is composed of a low-friction material, and thus the resistance to friction with the inner peripheral surface of the fixing belt 62 is reduced. The belt running guide 63 is composed of a low thermally conductive material, and suppresses heat conduction from the fixing belt 62. The structure of the fixing belt 62 is described below.

The fixing roll 61 and the fixing belt 62 are brought into contact with their outer peripheral surfaces and form a contact region N (pressing area) to which paper (P) is supplied. The fixing belt 62 is disposed so as to be relatively pressing against the fixing roll 61 at the contact region N. In the contact region N, the paper P is supplied via the fixing entrance guide 56.

The recording medium supplied to the contact region N is not limited to the paper P, and may be, for example, a sheet such as a plastic film. The sheet is not limited to a recording medium on which an image is recorded, and sheets for various applications may be used. In regard to the number of sheets, one sheet may be used, or plural sheets may be used as in the case of producing a laminated sheet.

The pressure pad 64 is disposed at the inner side of the fixing belt 62 and is pressed against the fixing roll 61 via the fixing belt 62, whereby the contact region N is formed between the fixing roll 61 and the fixing belt 62. The pressure pad 64 is supported by a holder 65, and the elastic pressure pad (for pre-nip) 64*b* is disposed at the inlet side of the contact region N so as to secure a contact region N of wide width. The high stiffness pad (for peeling nip) 64*a* is disposed at the outlet side of the contact region N so as to cause distortion in the fixing roll 61.

Examples of the material for the elastic pressure pad 64*b* include an elastomer such as a silicone rubber or a fluororubber, and a plate spring. The elastic pressure pad has a concave shape so as to conform to the shape of the outer peripheral surface of the fixing roll 61.

Examples of the material for the high stiffness pad 64*a* include a heat resistant resin such as polyphenylene sulfide (PPS), polyimide, polyester, or polyamide; materials reinforced by adding glass fiber or the like to those resins; and a metal such as iron, aluminum or SUS.

The sliding member 68 is provided at the surfaces of the elastic pressure pad 64*b* and the high stiffness pad 64*a* that are in contact with the fixing belt 62, and reduces the sliding resistance between the inner peripheral surface of the fixing belt 62 and the pressure pad 64. Examples of the material for the sliding member 68 include a sintered molded PTFE resin sheet, a glass fabric sheet impregnated with a fluororesin, and a laminated sheet produced by inserting a film sheet of a fluororesin between glass fabrics by heat fusion.

The pressure between the pressure pad 64 and the fixing roll 61 is applied by a load exerted by a member such as a spring (not shown), and the load is, for example, from about 100 N to about 350 N in a device for an A4 size recording medium (paper feed width of A4SEF), and from about 150 N to about 450 N in a device having a size equivalent to A3 size (paper feed width of A4LEF).

The holder 65 has a lubricant applying member 67 disposed along the longitudinal direction of the fixing apparatus 60. The lubricant applying member 67 is disposed so as to be in contact with the inner peripheral surface of the fixing belt 62, and supplies an appropriate amount of a lubricant such as amino-modified silicone oil. The lubricant applying member 67 supplies a lubricant to the sliding area between the fixing belt 62 and the sliding member 68, and thus the resistance to sliding between the fixing belt 62 and the pressure pad 65 via the sliding member 68 is further reduced.

The fixing apparatus 60 according to the exemplary embodiment of the invention also includes the meandering prevention member 80 that is in contact with the edge surfaces of the fixing belt 62 and prevents meandering of the fixing belt. FIG. 3 is a diagram illustrating the meandering prevention member.

As shown in FIG. 3, the meandering prevention member 80 has a support unit 801, a flange unit 802 and an insertion unit 803. The insertion units 803 are inserted from the two edges of the fixing belt 62, and the flange units 802 are disposed apart at a certain distance so that, upon meandering, the fixing belt 62 is bumped into the edge surfaces thereof.

The fixing belt 62 rotates along the outer peripheral surface of the belt running guide 63. The fixing belt 62 is pressed against the fixing roll 61 by the pressure pad 65, and driven-rotated by the frictional force from the fixing roll 61 due to the pressing force. At this time, the rotation is affected by the fluctuation in the part dimensions or by the paper P that passes through the contact region N. When the frictional force from the fixing roll 61 is non-uniform in the width direction, belt walk occurs in the fixing belt 62, in which a force acts that moves the fixing belt 62 in the width direction and the fixing belt 62 leans toward either one of its edges. By including the meandering prevention member 80, meandering of the fixing belt 62 is suppressed.

The meandering prevention member 80 is composed of a heat resistant resin such as PPS, PET, PBT or LCP, or from a product obtained by adding filler for decreasing durability or the coefficient of friction, to such a resin.

In the fixing apparatus 60 having this configuration, when the paper P having an unfixed toner image is passed through the region N where the fixing roll 61 and the fixing belt 62 are brought into contact, the paper P is pressed such that the surface having the unfixed toner image is contacted with the fixing roll 61, while an opposite surface to the surface having the unfixed toner image is contacted with the fixing belt 62, and at the same time, the unfixed toner image on the paper P is heated by the halogen heater 66 via the fixing roll 61, whereby the unfixed toner image is fixed to the paper P.

Fixing Belt

First Exemplary Embodiment

Figure 4:
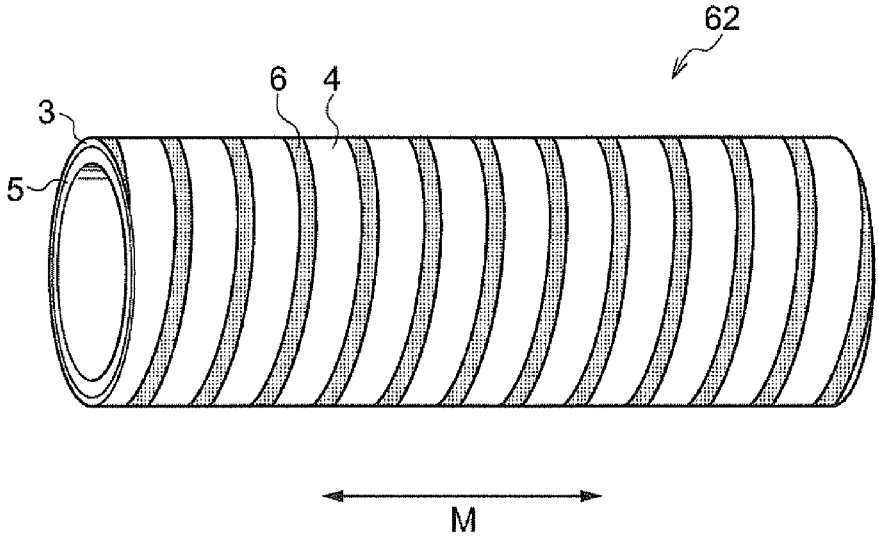
FIG. 4 is a schematic diagram showing an example of the fixing member according to a first exemplary embodiment of the invention.
Figure 5:
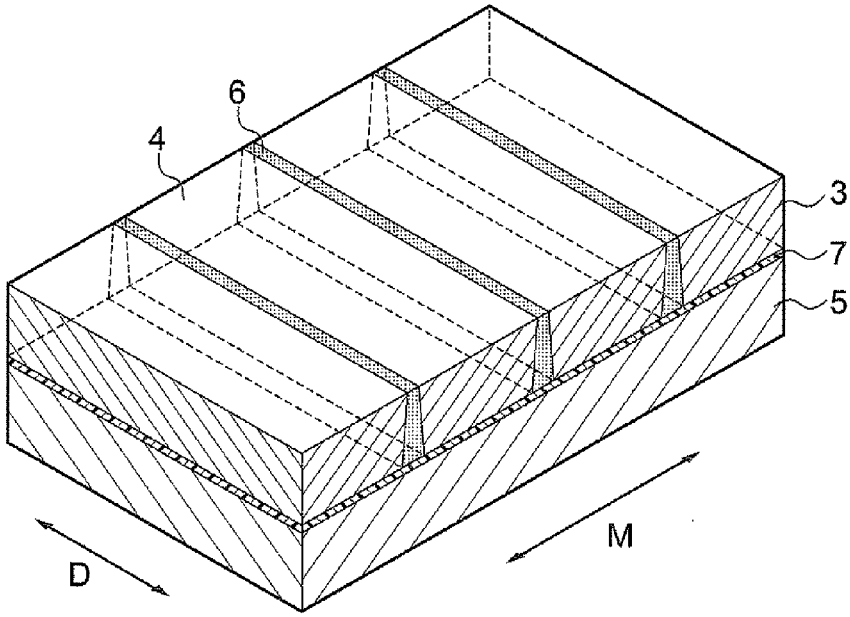
FIG. 5 is a schematic cross-sectional view under magnification showing a part of the surface layer of the fixing member according to the first exemplary embodiment.

As shown in FIGS. 4 and 5, the fixing belt 62 related to the first exemplary embodiment is a tubular shaped (cylindrically shaped) endless belt, and in this exemplary embodiment, the fixing belt includes a base layer 5 that serves as an inner peripheral layer, and a surface layer 3 that is fanned on the base layer 5 and serves as an outer peripheral layer, the base layer and the surface layer being adhered to each other.

Base Layer

The material for the base layer 5 is not particularly limited, and is usually selected from various known resin materials, metallic materials and the like.

As the resin material for the base layer 5, those materials called as engineering plastics are generally suitable. Examples of the engineering plastics include a fluororesin, polyimide (PI) (thermosetting polyimide, thermoplastic polyimide), fluorinated polyimide, polyamide-imide (PAI), polybenzimidazole (PBI), polyether ether ketone (PEEK), poly sulfone (PSU), polyether sulphone (PES), polyphenylene sulfide (PPS), polyetherimide (PEI), and total aromatic polyester (liquid crystalline polymer). Among these, polyimide, fluorinated polyimide, polyamide-imide, polyetherimide, and a fluororesin are preferable since they have excellent mechanical strength, heat resistance, abrasion resistance, chemical resistance or the like.

Examples of the metallic material for the base layer 5 include various metals such as SUS, nickel, copper and aluminum. The various resin materials and the various metallic materials may also be used in a layered state.

In order to impart strength as a fixing belt and to secure flexibility, the thickness of the base layer 5 is usually in the range of from 20 μm to 200 μm, and preferably in the range of from 40 μm to 100 μm.

Surface Layer

As shown in FIGS. 4 and 5, the surface layer 3 has a first band section 4 formed from a resin composition that contains a heat resistant resin having releasability (hereinafter, referred to as heat resistant resin section 4), and a second band section 6 having a higher mechanical strength than the resin composition (hereinafter, referred to as reinforced section 6). The heat resistant resin section 4 and the reinforced section 6 are disposed in a helical form along the circumferential direction (D) of the fixing belt 62, and are alternately disposed along the width direction of the respective sections, that is, along the entire span of the direction of the rotation axis (M) of the fixing belt 62, so as to form a striped pattern.

The mutual proportions of the heat resistant resin section 4 and the reinforced section 6 are not particularly limited, but from the viewpoint of securing releasability of the surface layer and also enhancing abrasion resistance, it is preferable that the width of the heat resistant resin section 4 is wider than the width of the reinforced section 6.

Specifically, from the viewpoint of securing releasability and also enhancing abrasion resistance more certainly, when the width combining the widths of one turn of the heat resistant resin section 4 and one turn of the reinforced section 6 is designated as 100%, the width of the heat resistant resin section 4 is preferably selected in the range of from 60% to 95% (in other words, the width of the reinforced section 6 is preferably selected in the range of from 5% to 40%).

The width in the axial direction combining the adjacent heat resistant resin section 4 and reinforced section 6 in the first exemplary embodiment, is preferably in the range of from about 0.1 mm to about 5 mm, and even more preferably of from about 0.5 mm to about 3 mm, from the viewpoint of securing releasability and also enhancing abrasion resistance more certainly.

Here, the reinforced section 6 has a higher mechanical strength than the resin composition (resin composition that contains a heat resistant resin having releasability) included in the heat resistant resin section 4. That is, the mechanical strength of the reinforced section 6 is higher than that of the heat resistant resin section 4, and this means that the Young's modulus (tensile modulus) of the reinforced section 6 is higher than that of the heat resistant resin section 4. If the resin composition contains a material other than the heat resistant resin having releasability (such as a filler material or a conductive agent), the reinforced section 6 has a higher mechanical strength than the resin composition including these materials.

Specifically, for example, it is preferable that the Young's modulus (tensile modulus) of the reinforced section 6 is higher by 300 MPa or more (and 30,000 MPa or less) than that of the resin composition included in the heat resistant resin section 4.

The Young's modulus (tensile modulus) is determined by a tensile test according to TIS K7127 (1999) (corresponds to ISO 527-3 (1995)), drawing a line tangent to the curve of the initial strain region of a stress-strain curve obtained from the tensile test, and determining the slope of the tangent line. The measurement is conducted using a strip specimen (width 6 mm, length 130 mm), and a dumbbell No. 1, with a test rate of 500 mm/min.

The heat resistant resin having releasability, which is contained in the resin composition included in the heat resistant resin section 4, is preferably a fluororesin which has heat resistance and also has excellent releasability with respect to toner.

Examples of the fluororesin include a tetrafluoroethylene-perfluoroalkyl vinyl ether copolymer (PFA), a tetrafluoroethylene-perfluoromethyl vinyl ether copolymer (MFA), a tetrafluoroethylene-perfluoroethyl vinyl ether copolymer (EFA), polytetrafluoroethylene (PTFE), a tetrafluoroethylene-hexafluoropropylene copolymer (FEP), polyethylene-tetrafluoroethylene (ETFE), polyvinylidene fluoride (PVDF), polychlorotrifluoroethylene (PCTFE), and vinyl fluoride (PVF). Among these, polytetrafluoroethylene (PTFE), a tetrafluoroethylene-perfluoroalkyl vinyl ether copolymer (PFA), a tetrafluoroethylene-perfluoromethyl vinyl ether copolymer (MFA), a tetrafluoroethylene-perfluoroethyl vinyl ether copolymer (EFA), or modification products thereof are preferable in view of heat resistance, mechanical properties and the like. Examples of a resin other than a fluororesin include a fluorinated polyimide.

These resins may be used singly or in combination of two or more kinds thereof. Furthermore, the molecular weight of the heat resistant resin is not particularly limited, and may be appropriately selected.

The resin composition included in the heat resistant resin section 4 may contain various filler materials as long as releasability with respect to toner is not impaired. The filler materials are not particularly limited, and are selected from, for example, known inorganic powdered materials and heat resistant resin powders. The average particle size of the filler material is preferably in the range of from about 1 μm to about 20 μm, and more preferably in the range of from about 2 μm to about 10 μm. The shape of the filler material is not particularly limited, and filler materials having an amorphous shape, a flake shape, a needle shape, a fibrous shape or the like may be used. Among these, an amorphous filler material is more preferable.

Examples of the inorganic powder material include a lubricious filler material having a layered structure, such as molybdenum disulfide, cubic boron nitride, mica, graphite, talc or graphite; a metal oxide such as aluminum oxide, titanium oxide, iron oxide, silicon oxide, cerium oxide, or a composite metal oxide; a carbide such as silicon carbide or boron carbide; a nitride such as cubic boron nitride or silicon nitride; and glass powder, aluminum silicate, aluminum borate, a metal powder, carbon fiber, potassium titanate, barium sulfate, and a silicate compound. Examples of the heat resistant resin for the heat resistant resin powder include (fluorinated) polyimide, polyamide-imide, polybenzimidazole, a total aromatic polyester resin, modified PTFE, and crosslinked PTFE. Furthermore, a powder obtained by microencapsulating an inorganic filler in a heat resistant resin, may also be used. The inorganic filler may also be surface treated with a fluorine-containing coupling agent, in order to enhance adhesiveness to a fluororesin.

The resin composition included in the heat resistant resin section 4 may contain various conductive agents for the purpose of preventing electrostatic offset. Examples of the electroconductive agent include the following electron-conducting conductive agent and ion-conducting conductive agent.

Examples of the electron-conducting conductive agent include carbon black, graphite, a metal or an alloy such as aluminum, nickel or a copper alloy; and a metal oxide such as tin oxide, zinc oxide, potassium titanate, or a composite oxide of tin oxide-indium oxide or tin oxide-antimony oxide.

Examples of the ion-conducting conductive agent include a sulfonic acid salt, an ammonium salt, and various cationic, anionic and nonionic surfactants.

The material for the reinforced section 6 is not particularly limited as long as it is a material having a higher mechanical strength than that of the resin composition included in the heat resistant resin section 4, and having heat resistance. Similarly to the resin materials constituting the base layer 5, examples of the material include a fluororesin, polyimide (PI) (thermosetting polyimide, thermoplastic polyimide), fluorinated polyimide, polyamide-imide (PAI), polybenzimidazole (PBI), polyether ether ketone (PEEK), polysulfone (PSU), polyethersulfone (PES), polyphenylene sulfide (PPS), polyether imide (PET), and total aromatic polyester (liquid crystalline polymer), which are generally called as engineering plastics. Among these, polyimide, fluorinated polyimide, polyamide-imide, polyether imide, and a fluororesin are preferable since they are excellent in mechanical strength, heat resistance, abrasion resistance, chemical resistance, and the like.

The reinforced section 6 may have a configuration in which the above filler material is added to a resin material for the purpose of increasing the mechanical strength thereof.

The fixing belt 62 according to the first exemplary embodiment may be formed by forming a layer of a rubber material on the entire surface or a part of the surface of the base layer 5. Examples of the rubber material include a urethane rubber, an ethylene-propylene rubber (EPM), a silicone rubber, and a fluororubber (FKM). Among these, a silicone rubber is preferable because it has excellent heat resistance and processability. The thickness of the rubber material is, for example, from 30 μm to 500 μm, and preferably from 100 μm to 300 μm.

In addition, the layers other than the surface layer 3 of the fixing belt 62 may also contain various filler materials depending on the purpose of electrical conductivity, heat conductivity, insulation property, releasing property, sliding property and reinforcement. Here, materials such as those added to the surface layer 3 may be used as the additive materials.

The fixing belt 62 according to the first exemplary embodiment usually has a two-layered structure obtained by forming the surface layer 3 including a heat resistant resin as a main component on the base layer 5, but the fixing belt is not limited to the two-layered structure. For example, as shown in FIG. 5, another layer such as an adhesive layer 7 may be formed between the base layer 5 and the surface layer 3. Furthermore, the fixing belt may have a single-layered structure having only the surface layer 3 including a heat resistant resin as a main component. The fixing belt 62 is not particularly limited in terms of the material, shape, size or the like.

The method for producing the fixing belt 62 according to the first exemplary embodiment is not particularly limited. For example, the fixing belt 62 according to the first exemplary embodiment is produced according to the following method.

First, two kinds of coating liquids for forming the heat resistant resin section 4 and for forming the reinforced section 6 (a first coating liquid and a second coating liquid, respectively) are prepared. Each of these two coating liquids is then placed in a separate supply vessel for coating liquid pressure-feeding equipped with a coating liquid ejection outlet. Subsequently, these two supply vessels for coating liquid pressure-feeding are mounted such that the supply vessels are disposed adjacent to each other at a constant interval in the axial direction of a cylindrical-shaped mold, and each coating liquid ejection outlet is disposed near the surface of a layer composed, for example, of a polyimide precursor that has been formed in advance.

Next, the cylindrical-shaped mold is rotated, and while the supply vessels for coating liquid pressure-feeding are moved along the axial direction of the mold, the first coating liquid and the second coating liquid are simultaneously ejected from the respective coating liquid ejection outlets. While the first coating liquid and the second coating liquid are applied alternately in the axial direction of the mold to the surface of the polyimide precursor applied on the mold, the mold is further rotated, and the coating liquids are dried in a heated state. A further heat treatment is performed, whereby a surface layer 3 is formed on a base layer 5 composed of a cured product of the polyimide precursor. According to this production method, the surface layer 3 is formed such that two kinds of parts (heat resistant resin section 4 and reinforced section 6) are respectively formed alternately along the axial direction and continuously along the circumferential direction.

As a method other than the production method described above, for example, a method in which the surface layer is formed by applying the first coating liquid on the surface of a cylindrical-shaped mold, and then applying the second coating liquid with a certain interval.

Figure 6:
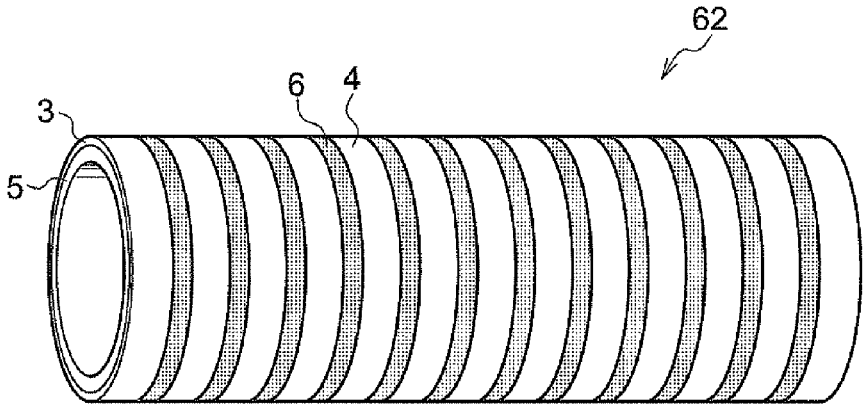
FIG. 6 is a schematic diagram showing another example of the fixing member according to the first exemplary embodiment of the invention.

Here, the fixing belt 62 according to the first exemplary embodiment is not limited to the above-described constitution. For example, as shown in FIG. 6, a ring-like heat resistant resin section 4 and a ring-like reinforced section 6, which are provided along the circumferential direction of the fixing belt 62, may be formed alternately in their width direction, that is, along the axial direction of the fixing belt 62, and disposed in parallel.

Secondary Exemplary Embodiment

Figure 7:
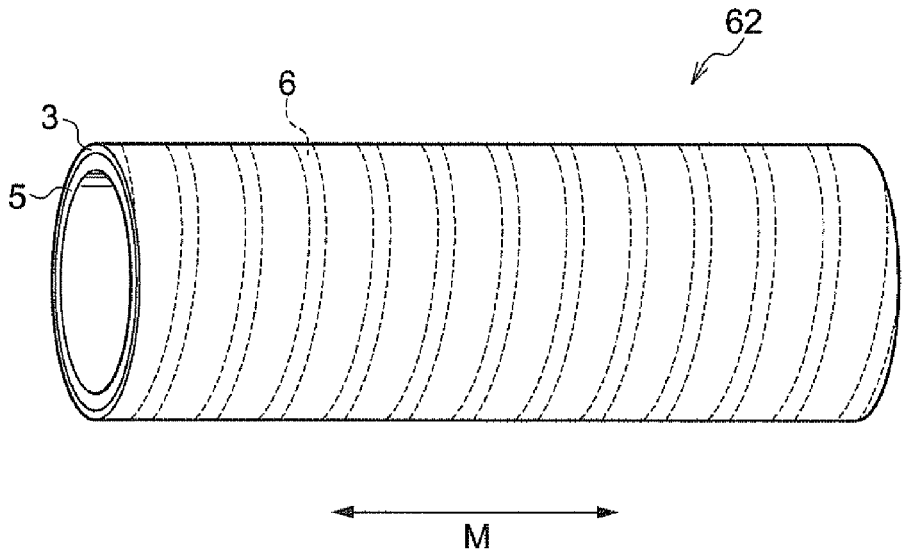
FIG. 7 is a schematic diagram showing an example of the fixing member according to a second exemplary embodiment.
Figure 8:
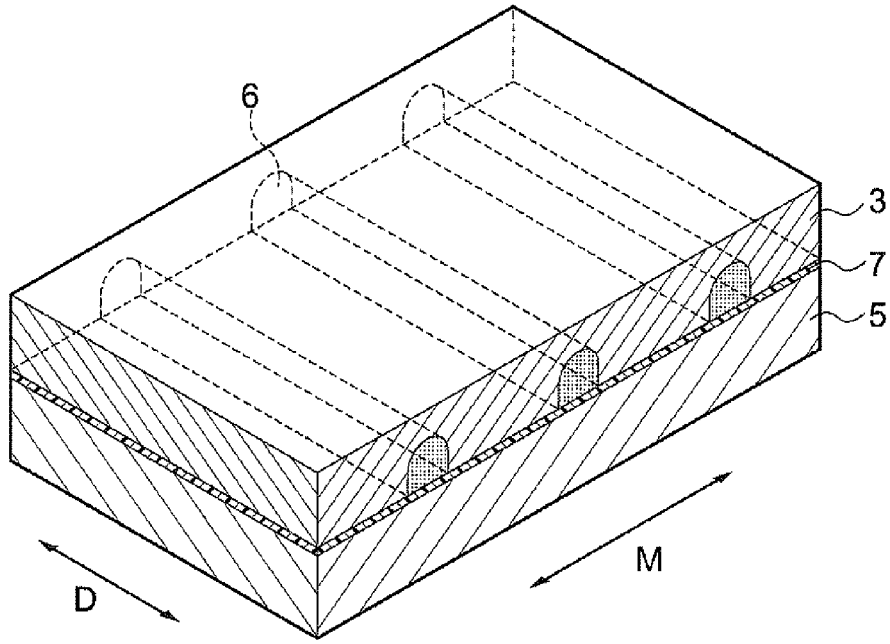
FIG. 8 is a schematic cross-sectional view under magnification showing a part of the surface layer of the fixing member according to the second exemplary embodiment of the invention.

As shown in FIGS. 7 and 8, the fixing belt 62 according to the second exemplary embodiment of the invention is a tubular (cylindrical shape) endless belt, and in this exemplary embodiment, the fixing belt is composed of a base layer 5 as an inner peripheral layer, and a surface layer 3 serve as an outer peripheral layer disposed on the base layer 5, the base layer and the surface layer being adhered to each other.

As shown in FIGS. 7 and 8, in the fixing belt 62 according to the second exemplary embodiment of the invention, the surface layer 3 is composed of a resin composition that contains a heat resistant resin having releasability, and a band section 6 having a higher mechanical strength than the resin composition (hereinafter, referred to as reinforced section 6) is embedded in the surface layer 3. The reinforced section 6 is helically disposed along the circumferential direction of the fixing belt 62 within the surface layer 3, and is disposed at an interval along the width direction (D) of the surface layer, that is, along the direction of the rotation axis (M) of the fixing belt 62.

The interval between the turns of the reinforced section 6 may be, for example, from 0.1 mm to 5 mm, from the viewpoint of enhancing abrasion resistance.

The thickness of the reinforced section 6 is preferably thinner than the thickness of the surface layer 3, and may be from 10% to 90% of the thickness of the surface layer 3.

Here, the reinforced section 6 has a higher mechanical strength than that of the resin composition (the resin composition that includes a heat resistant resin having releasability) included in the surface layer 3. That is, the reinforced section 6 has a higher mechanical strength than that of the heat resistant resin section 4, and this means that the Young's modulus (tensile modulus) of the reinforced section 6 is higher than that of the heat resistant resin section 4. If the resin composition contains a material other than the heat resistant resin having releasability (such as a filler material or a conductive agent), the reinforced section 6 has a higher mechanical strength than that of the resin composition including these materials.

Specifically, for example, it is preferable that the Young's modulus (tensile modulus) of the reinforced section 6 is higher by 300 MPa or more (and 30,000 MPa or less) than that of the resin composition included in the heat resistant resin section 4.

The Young's modulus (tensile modulus) is determined by a tensile test according to JIS K7127 (1999) (corresponds to ISO 527-3 (1995)), drawing a line tangent to the curve of the initial strain region of a stress-strain curve obtained from the tensile test, and determining the slope of the tangent line. The measurement is conducted using a strip specimen (width 6 mm, length 130 mm), and dumbbell No. 1, with a test rate of 500 mm/min.

The method for producing the fixing belt 62 according to the second exemplary embodiment of the invention is not particularly limited. For example, the fixing belt 62 according to the second exemplary embodiment is produced according to the following method.

First, two kinds of coating liquids for forming the surface layer 3 and for forming the reinforced section 6 (a first coating liquid and a second coating liquid, respectively) are prepared. Next, the coating liquid for forming the reinforced section 6 is applied in a helical form on the surface of a layer composed of a polyimide precursor that has been formed in advance, and then the coating liquid for forming the surface layer 3 is applied over the entire surface of the layer composed of the polyimide precursor. Then, a heating treatment is conducted, whereby a surface layer 3 is formed on the base layer 5 composed of a cured product of the polyimide precursor.

Except for these, the base layer 5, constitution of the resin composition, and constitution of the reinforced section 6 of the second exemplary embodiment are the same as those of the first exemplary embodiment, and thus explanations thereof is not be repeated.

Figure 9:
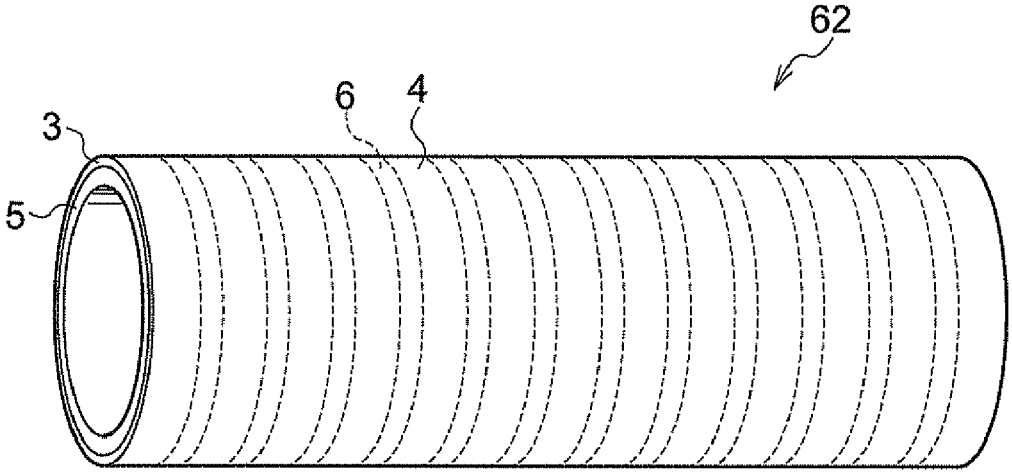
FIG. 9 is a schematic diagram showing another example of the fixing member according to the second exemplary embodiment of the invention.

Similarly to the first exemplary embodiment, the fixing belt 62 according to the second exemplary embodiment of the invention is not limited to the reinforced section 6 that is disposed in a helical form. As shown in FIG. 9, a ring-like heat resistant resin section 4 and a ring-like reinforced section 6, which are provided along the circumferential direction of the fixing belt 62, may be formed alternately in their width direction, that is, along the axial direction of the fixing belt 62, and disposed in parallel.

Other Fixing Apparatus

In the first and second exemplary embodiments, the fixing belt 62 have been explained, but the invention is not limited to these, and a form in which the fixing belt is suitable for a fixing roll may also be used. Examples of a fixing apparatus equipped with such kind of fixing roll include a fixing apparatus of an electromagnetic induction system and other fixing apparatus using a roll-to-roll heat fixing system.

Figure 10:
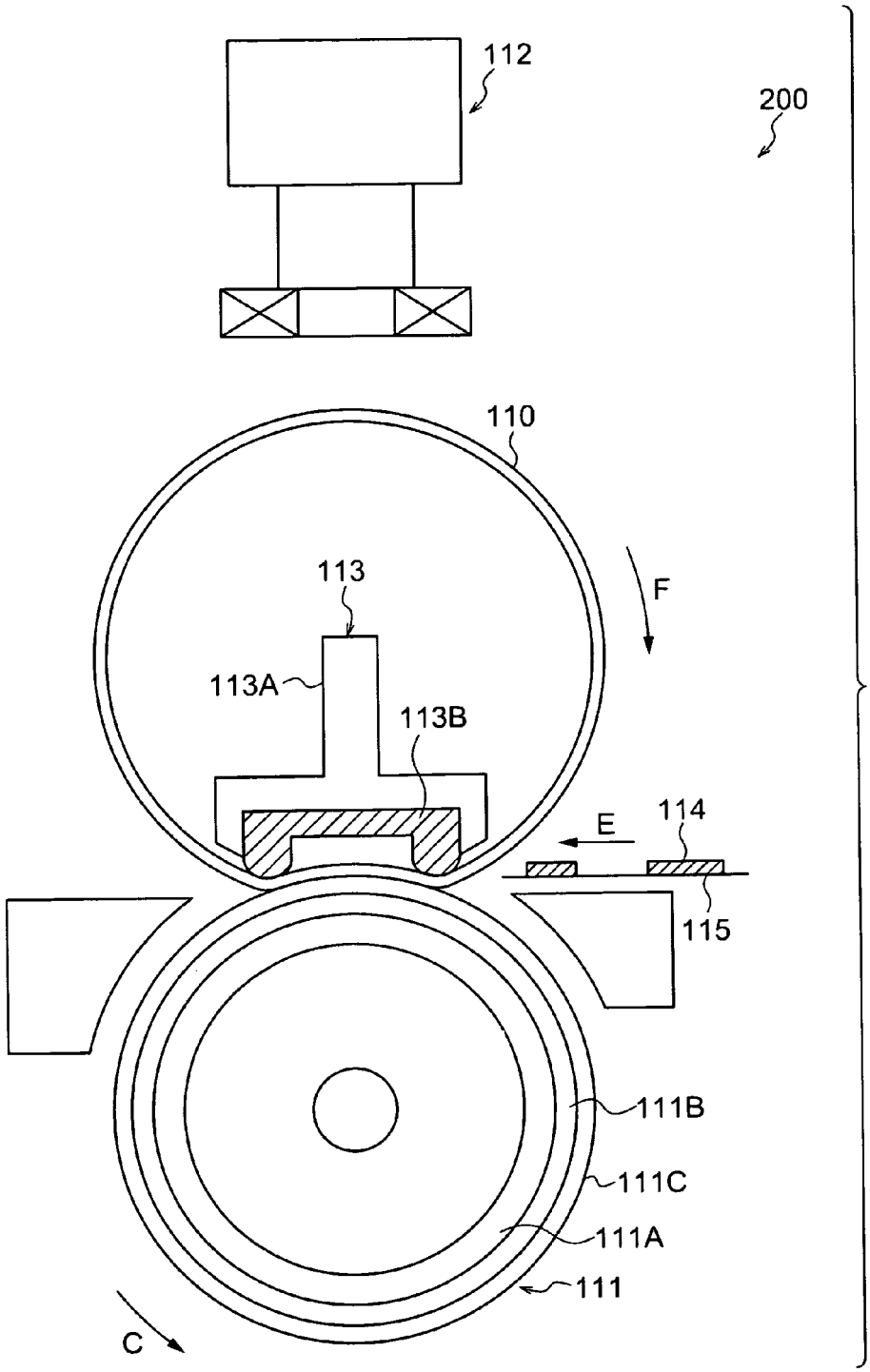
FIG. 10 is a schematic constitutional diagram showing another example of the fixing apparatus according to an exemplary embodiment of the invention.

FIG. 10 shows an example of the fixing apparatus of an electromagnetic induction system, as another example of the fixing apparatus according to the exemplary embodiment of the invention. In this fixing apparatus 200, as shown in FIG. 10, a fixing roll 111 is disposed so as to press a part of a fixing belt 110, so that a contact region is formed between the fixing belt 110 and the fixing roll 111. In the contact region, the fixing belt 110 bends in a shape conforming to the peripheral surface of the fixing roll 111.

The fixing roll 111 is composed of a base material 111A, an elastomer layer 111B composed of a silicone rubber or the like formed on the base material 111A, and a releasing layer 111C, which serves as a surface layer and includes a fluororesin or the like, formed on the elastomer layer 111B.

On the inner side of the fixing belt 110, a pressing member 113 is disposed at a position opposite to the fixing roll 111. The pressing member 113 is composed of a metal, a heat resistant resin, a heat resistant rubber or the like, and has a pad 113B that is in contact with the inner peripheral surface of the fixing belt 110 and locally increases pressure and a support 113A that supports the pad 113B.

At a position that is opposite to the fixing roll 111, with the fixing belt 110 disposed in between, an electromagnetic induction heating apparatus 112 mounted with an electromagnetic induction coil (excitation coil) is provided. The electromagnetic induction heating apparatus 112 alters a magnetic field that is generated by applying an alternating current to the electromagnetic induction coil, at an excitation circuit, and generates an eddy current in a metal heat-generating layer that constitutes a part of the fixing belt 110. This eddy current is converted to heat (Joule's heat) by the electrical resistance of the metal heat-generating layer, and consequently, the surface of the fixing belt 110 generates heat. The position of the electromagnetic induction heating apparatus 112 is not limited, and, for example, may be provided at the inner side of the fixing belt 110.

By rotary-driving one of the fixing belt 110 and the fixing roll 111 while driving the other, the fixing belt 110 is rotated in the direction of arrow F, and the fixing roll 111 is rotated in the direction of arrow C. A recording medium 115 having an unfixed toner image 114 is moved in the direction of arrow E to fix the toner image.

In this fixing apparatus 200 of an electromagnetic induction heating system, the recording medium 115 passes through the fixing apparatus, while an opposite surface of the recording medium to a surface having the unfixed toner image 114 is in contact with the outer peripheral surface of the fixing roll 111. For example, in the fixing apparatus 200 of an electromagnetic induction heating system, the fixing roll 111 with which an opposite surface of the recording medium 115 to a surface having the unfixed toner image 114 is in contact, is frequently subjected to intense exertion of a force of friction or turning in the direction of conveyance of the recording medium at the edges of the recording medium, as compared with the fixing belt 110 that is brought into contact with the surface having the unfixed toner image 114 in the recording medium 115. For this reason, when a fixing roll having a surface layer 111C according to the first or second exemplary embodiment of invention is used as the fixing roll 111, abrasion due to the edges of the recording medium 115 in the surface layer 111C of the fixing roll 111 may be effectively suppressed.

EXAMPLES

Hereinbelow, the exemplary embodiment of the invention is explained in detail by way of Examples. The invention is not intended to be limited to the following Examples so long as the gist of the invention is maintained.

Paper Passage Test in Image Forming Apparatus

Each of the endless belts produced in Examples 1 and 2 and Comparative Example 1 described below is mounted in the fixing apparatus shown in FIG. 2 as a fixing belt, and this fixing apparatus is installed in the image forming apparatus shown in FIG. 1, and a paper passage test is conducted under the following conditions. In the test, C2 paper (trade name, manufactured by Fuji Xerox Co., Ltd.) is used as the paper, and the image density is adjusted to 5%, with character images.

100,000 sheets of images are formed using the image forming apparatus, and after completion of the operation, evaluations are made of the state of abrasion of the surface layer of the fixing belt, the state of sticking of toner, and the effect on the image on the rear side (belt-contacting surface side) upon double-sided printing at a high image density (100%).

The fixing roll in the fixing apparatus is molded by inserting a PFA tube and a carbon steel tube into a mold (having an internal diameter of about 26.2 mm) and then injecting a silicone rubber into the gap between the PFA tube and the carbon steel tube, so that a silicone rubber (trade name: LSR, manufactured by Shin-Etsu Chemical Co., Ltd.) having a thickness of 0.6 mm, and a PFA tube having a thickness of 30 μm as the outermost surface layer are integratedly coated on the surface of a carbon steel tube having a thickness of 0.5 mm and an outer diameter of 25 mm. The PFA tube is produced by extrusion molding PFA (trade name: 950HP-PLUS, manufactured by Dupont-Mitsui Fluorochemicals Co., Ltd.), and treating the inner surface with an excimer laser light.

During the paper passage test, the pressure in the contact region between the fixing roll and the fixing belt (nip pressure) is increased to 1.5 times of the ordinary pressure, and the amount of an oil lubricant supplied on the inner side of the fixing belt is adjusted to 25% of the ordinary amount. As such, strict conditions are used as the evaluation conditions, and abrasion resistance of the fixing belt is evaluated.

Further, the state of sticking of toner is evaluated by visual inspection.

Maximum Amount of Abrasion of Surface Layer

The thickness of the fixing belt prior to image forming, and the thickness of the fixing belt after forming 100,000 sheets of images are respectively measured, and the amount of thickness change before and after the image forming is designated as the amount of abrasion. The amount of abrasion is measured over the entire length of the fixing belt, at an interval of 5 mm, along the axial direction of the fixing belt. Measurement in the circumferential direction is made at 4 sites with an interval of 90°. The maximum value among those measurement values is taken as the maximum amount of abrasion of the surface layer.

Measurement of the thickness of the surface layer is carried out using an eddy current type thickness meter (trade name: ISOSCOPE MP30, manufactured by Fischer Instruments K.K.).

Example 1

An endless belt is produced according to the following procedure. First, the surface of an aluminum cylindrical tube having an outer diameter of 30 mm and a length of 500 mm is roughened by a blast treatment, and a silicone-containing releasing agent is applied thereon and dried for 60 minutes at 200° C. Thereafter, the silicone-containing releasing agent is baked by further heating for 30 minutes at 340° C., whereby a mold having a silicone-containing releasing agent baked on the surface and having a surface roughness Ra of 0.8 μm is prepared.

Next, an N-methylpyrrolidone solution of a polyimide precursor (trade name: U-VARNISH-S, manufactured by Ube Industries. Ltd.) having a viscosity adjusted to 120 Pa·s, is applied on the central area of 470 mm of the prepared mold by a flow coating (helical winding coating) method. Subsequently, while the mold is rotated at 100° C. for 50 minutes, the coating liquid is dried, and the applied polyimide precursor is smoothed.

Separately, barium sulfate having an average particle size of 5 μm as a filler material (trade name: BMH-60, manufactured by Sakai Chemical Industry Co., Ltd.) is added to a fluororesin (PFA) dispersion solution (trade name: 945HP-PLUS, manufactured by Dupont-Mitsui Fluorochemicals Co., Ltd.), such that the content of barium sulfate with respect to the total solid content is 10% by weight.

Subsequently, carbon black (Ketjen black dispersion solution manufactured by Lion Corp.) as an electroconductive agent is added to the mixture, such that the content of the carbon black with respect to the total solid content is 2% by weight. Furthermore, the viscosity of the solution is adjusted using water and a thickening agent, whereby a first coating liquid is prepared. The total solid concentration in this coating liquid is 50% by weight.

Subsequently, N-methylpyrrolidone is added to an N-methylpyrrolidone solution of a polyimide precursor (trade name: U-VARNISH-S, manufactured by Ube Industries. Ltd.) which is obtained similarly to that used in the production of the base material layer, whereby a second coating liquid in which the solid content in the varnish is adjusted to 7% is prepared.

The first coating liquid and the second coating liquid are then respectively placed in two different supply vessels for coating liquid pressure-feeding. The two supply vessels for coating liquid pressure-feeding are mounted such that the supply vessels are placed adjacent to each other in the axial direction of a mold (cylindrical tube made of aluminum), to the surface of which a polyimide precursor has been applied, and such that the respective coating liquid ejection outlets (interval 1.2 mm) are disposed near the surface of the layer on which a polyimide precursor has been formed.

Subsequently, the cylindrical tube-shaped mold is rotated, and while the supply vessels for coating liquid pressure-feeding are moved along the axial direction of the mold, the first coating liquid and the second coating liquid are simultaneously ejected from the respective coating liquid ejection outlets. Then, while the first coating liquid and the second coating liquid are alternately applied on the surface of the polyimide precursor applied on the mold, in a helical form with respect to the axial direction of the mold, the mold is further rotated, and the coating liquids are dried at 80° C. for 10 minutes. Furthermore, calcination is performed at 380° C. for 60 minutes, whereby the polyimide precursor is cured.

The film formed on the surface of the mold is detached from the mold surface, and the two edges are cut to obtain a endless belt. The obtained endless belt had a base layer composed of a polyimide resin having a thickness of 85 μm, and a surface layer having a thickness of 25 μm formed on the outer periphery of the base layer. The endless belt had an inner diameter of 30 mm and a total length of 352 mm.

On the surface of the obtained endless belt, a heat resistant resin section (first band section) having a width of 1 mm and composed of a fluororesin formed along the circumferential direction, and a reinforced section (second band section) having a width of 0.3 mm and composed of polyimide formed along the circumferential direction, are disposed alternately in the width direction of the endless belt and formed in a spiral form (see FIGS. 4 and 5).

The heat resistant resin section has a Young's modulus of 510 MPa, and the reinforced section has a Young's modulus of 6600 MPa.

The endless belt thus produced is mounted on the fixing apparatus as a fixing belt, and a paper passage test is performed using an image forming apparatus. The endless belt is mounted such that when paper passed through the contact region between the fixing belt and the fixing roll, an opposite surface of the paper to a surface having an unfixed toner image would be in contact with the outer peripheral surface of the fixing belt. The results are shown in Table 1.

Example 2

A polyimide precursor is applied on the surface of a mold constituted of a cylindrical tube made of aluminum, and the polyimide precursor is smoothed in the same manner as in Example 1.

Separately, barium sulfate having an average particle size of 5 μm as a filler material (trade name: BMH-60, manufactured by Sakai Chemical Industry Co., Ltd.) is added to a fluororesin (PFA) dispersion solution (trade name: 945HP-PLUS, manufactured by Dupont-Mitsui Fluorochemicals Co., Ltd.), such that the content of barium sulfate with respect to the total solid content is 10% by weight.

Subsequently, carbon black (Ketjen black dispersion solution manufactured by Lion Corp.) as an electroconductive agent is added to the mixture, such that the content of the carbon black with respect to the total solid content is 2% by weight. Furthermore, the viscosity of the solution is adjusted using water and a thickening agent, whereby a first coating liquid is prepared. The total solid concentration in this coating liquid is 50% by weight.

Subsequently, N-methylpyrrolidone is added to an N-methylpyrrolidone solution of a polyimide precursor (trade name: U-VARNISH-S, manufactured by Ube Industries. Ltd.) which is obtained similarly to that used in the production of the base material layer, whereby a second coating liquid in which the solid content in the varnish is adjusted to 11% is prepared.

Subsequently, the first coating liquid and the second coating liquid are respectively placed in two different supply vessels for coating liquid pressure-feeding in the same manner as in Example 1. Next, the two supply vessels for coating liquid pressure-feeding are mounted such that the supply vessels are placed adjacent to each other in the axial direction of a mold (cylindrical tube made of aluminum), to the surface of which a polyimide precursor has been applied, and such that the respective coating liquid ejection outlets (interval 1.2 mm) are disposed near the surface of the layer on which a polyimide precursor has been formed.

Subsequently, the cylindrical tube-shaped mold is rotated, and while the supply vessels for coating liquid pressure-feeding are moved along the axial direction of the mold, the first coating liquid and the second coating liquid are simultaneously ejected from the respective coating liquid ejection outlets. Then, while the first coating liquid and the second coating liquid are alternately applied on the surface of the polyimide precursor applied on the mold, in a helical form with respect to the axial direction of the mold, the mold is further rotated, and the coating liquids are dried at 80° C. for 10 minutes.

Here, in Example 2 as compared with Example 1, the second coating liquid is applied in precedence, and the amount of ejection of the first coating liquid is made larger relative to the second coating liquid, so that the first coating liquid is completely cover over the second coating liquid.

Baking is further performed at 380° C. for 60 minutes, and thus the polyimide precursor is cured.

The film formed on the surface of the mold is detached from the mold surface, and the two edges are cut to obtain a endless belt. The obtained endless belt had a base layer composed of a polyimide resin having a thickness of 85 μm, and a surface layer formed on the outer periphery of the base layer and has a thickness of 25 μm. The endless belt had an inner diameter of 30 mm and a total length of 352 mm.

On the surface of the obtained endless belt, a reinforced section having a thickness of 20 μm and a width of about 0.3 mm and composed of polyimide formed along the circumferential direction, are embedded in a surface layer composed of a fluororesin in a helical form having a pitch of 1 mm in the width direction (see FIGS. 7 and 8).

The surface layer other than the reinforced section has a Young's modulus of 510 MPa, and the reinforced section has a Young's modulus of 6600 MPa.

The endless belt thus produced is mounted on the fixing apparatus as a fixing belt in the same manner as in Example 1, and a paper passage test is performed using an image forming apparatus. The results are shown in Table 1.

Comparative Example 1

The same operation is carried out as in Example 1, except that only the first coating liquid prepared similarly to Example 1 is used, whereby an endless belt having a surface layer having an identical composition over the entire surface is produced.

The endless belt thus obtained has a base layer composed of a polyimide resin having a thickness of 70 μm, and a surface layer formed on the outer periphery of the base layer and has a thickness of 25 μm. The endless belt has an inner diameter of 30 mm and a total length of 352 mm.

The surface of the obtained endless belt is composed of an identical composition of a fluororesin, over the entire surface. The endless belt thus produced is mounted on a fixing apparatus as a fixing belt in the same manner as in Example 1, and a paper passage test is performed using an image forming apparatus. The results are shown in Table 1.

TABLE 1

| | | Evaluation results obtained with actual equipment | | |
|---|---|---|---|---|
| | Configuration of surface layer | Maximum amount of surface abrasion | Toner sticking to belt surface | Effect on rear surface of double-sided printing |
| Example 1 | Configuration shown in FIGS. 4 and 5 (configuration in which a heat resistant resin section having a width of 1 mm and composed of a fluororesin formed along the circumferential direction, and a reinforced section having a width of 0.3 mm and composed of a polyimide formed along the circumferential direction, are alternately disposed in the width direction of the endless belt and are formed in a helical form) | 6.9 μm (at passage areas of paper edges) | None | Very slight gloss unevenness occurs at the surface contacting the belt upon high image density printing |
| Example 2 | Configuration shown in FIGS. 7 and 8 (configuration in which a reinforced section having a thickness of 20 μm and a width of about 0.3 mm composed of a polyimide formed along the circumferential direction is embedded in a surface layer composed of a fluororesin, in a helical form having a pitch of 1 mm in the width direction of the endless belt) | 10.2 μm (at passage areas of paper edges) | None | None |

TABLE 1-continued

| | Configuration of surface layer | Evaluation results obtained with actual equipment | | |
|---|---|---|---|---|
| | | Maximum amount of surface abrasion | Toner sticking to belt surface | Effect on rear surface of double-sided printing |
| Comparative Example 1 | Configured by an identical composition of a fluororesin over the entire surface | 25 μm or more (the passage areas of the paper edges are completely worn down and the foundation is denuded) | Toner sticking occurred at the area where the foundation of the edges is denuded | Paper curling toward the belt occurs |

It can be seen from the results shown in Table 1 that in the endless belts having a reinforced section (Examples 1 and 2), the maximum amount of abrasion of the surface is effectively suppressed as compared with the case of a endless belt having no reinforced section (Comparative Example 1). It can also be seen that, although Example 2 is inferior to Example 1 in the maximum amount of abrasion (paper edges), Example 2 exhibits more excellent releasability.

The exemplary embodiments and Examples have been described as shown above, but the present invention is not intended to be limited to the above exemplary embodiments and Examples, and various modifications may be carried out within the scope of the gist of the invention.

The foregoing description of the exemplary embodiments of the present invention has been provided for the purposes of illustration and description. It is not limited to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing member, comprising:

an outermost tubular surface layer having a first band section comprising a resin composition that contains a heat resistant resin having releasability, and a second band section having a higher mechanical strength than the resin composition, the first band section and the second band section being respectively disposed along a circumferential direction of the outermost tubular surface layer and being disposed alternately in a width direction of the outermost tubular surface layer, a width of the second band section being in a range of from 60% to 95% when the width combining the widths of one turn of the first band section and one turn of the second band section is designated as 100%, and a width in an axial direction combining the adjacent first band section and second band section being in a range of from 0.1 mm to 5 mm.

2. A fixing apparatus, comprising:

a first rotating body that is rotary-driven;

a second rotating body that is disposed such that the outer peripheral surface thereof is brought into contact with the outer peripheral surface of the first rotating body and that rotates in conjunction with rotation of the first rotating body; and a heating unit that heats an unfixed toner image onto a recording medium via the first rotating body or the second rotating body when a recording medium having an unfixed toner image is passed through the region where the first rotating body and the second rotating body are brought into contact, at least one of the first rotating body or the second rotating body including the fixing member according to claim 1.

3. The fixing apparatus according to claim 2, wherein one of the first rotating body or the second rotating body includes the fixing member, and the outer peripheral surface of the fixing member is brought into contact with an opposite surface of the recording medium to a surface having the unfixed toner image.

4. An image forming apparatus, comprising:

an image holding member;

a charging unit that charges a surface of the image holding member;

an electrostatic latent image forming unit that forms an electrostatic latent image on the charged surface of the image holding member;

a developing unit that develops the electrostatic latent image on the image holding member using a developer containing a toner to form a toner image;

a transfer unit that transfers the toner image formed on the surface of the image holding member to an image recording medium; and a fixing unit that fixes the toner image to the recording medium, the fixing unit including the fixing apparatus according to claim 2.

5. An image forming apparatus, comprising:

an image holding member;

a charging unit that charges a surface of the image holding member;

an electrostatic latent image forming unit that forms an electrostatic latent image on the charged surface of the image holding member;

a developing unit that develops the electrostatic latent image on the image holding member using a developer containing a toner to form a toner image;

a transfer unit that transfers the toner image formed on the surface of the image holding member to an image recording medium; and a fixing unit that fixes the toner image to the recording medium, the fixing unit including the fixing apparatus according to claim 3.

* * * * *